US008491073B2

(12) United States Patent
Hong et al.

(10) Patent No.: US 8,491,073 B2
(45) Date of Patent: Jul. 23, 2013

(54) INKJET PRINTING DEVICES AND METHODS OF DRIVING THE SAME

(75) Inventors: Young-ki Hong, Anyang-si (KR); Jae-woo Chung, Yongin-si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 672 days.

(21) Appl. No.: 12/588,154

(22) Filed: Oct. 6, 2009

(65) Prior Publication Data

US 2010/0194800 A1 Aug. 5, 2010

(30) Foreign Application Priority Data

Feb. 4, 2009 (KR) ..... 10-2009-0008848

(51) Int. Cl.
*B41J 29/38* (2006.01)

(52) U.S. Cl.
USPC ..... 347/9; 347/68

(58) Field of Classification Search
USPC ..... 347/9–11, 54–55, 68
See application file for complete search history.

(56) References Cited

U.S. PATENT DOCUMENTS

| | | | | |
|---|---|---|---|---|
| 7,314,185 | B2 | 1/2008 | Nishi et al. | |
| 2002/0122099 | A1 | 9/2002 | Furukawa | |
| 2006/0077237 | A1 * | 4/2006 | Shin et al. | 347/71 |
| 2006/0092237 | A1 * | 5/2006 | Kwon et al. | 347/68 |
| 2007/0216730 | A1 * | 9/2007 | Onozawa | 347/55 |
| 2008/0074476 | A1 * | 3/2008 | Yoo et al. | 347/71 |
| 2008/0122887 | A1 * | 5/2008 | Ueno et al. | 347/10 |
| 2009/0096843 | A1 * | 4/2009 | Chung et al. | 347/72 |
| 2009/0189956 | A1 * | 7/2009 | Lee et al. | 347/55 |

FOREIGN PATENT DOCUMENTS

| | | |
|---|---|---|
| JP | 9-327908 | 12/1997 |
| JP | 9-327909 | 12/1997 |
| JP | 11-320890 | 11/1999 |
| JP | 2003-165220 | 6/2003 |
| JP | 2008-080807 | 4/2008 |

OTHER PUBLICATIONS

An English language abstract of Japanese Publication No. JP 2001-278390, published Oct. 10, 2001.

* cited by examiner

*Primary Examiner* — Charlie Peng
*Assistant Examiner* — Peter Radkowski
(74) *Attorney, Agent, or Firm* — Harness, Dickey & Pierce, P.L.C.

(57) ABSTRACT

An inkjet printing device includes: a flow path plate, a piezoelectric actuator and an electrostatic force applicator. The flow path plate includes an ink inlet, a pressure chamber and a nozzle. The piezoelectric actuator is configured to provide a first driving force, and the electrostatic force applicator is configured to provide a second driving force. The disclosed inkjet printing devices and methods combine piezoelectric and electrostatic techniques.

18 Claims, 8 Drawing Sheets

INKJET PRINTING DEVICES AND METHODS OF DRIVING THE SAME

CROSS-REFERENCE TO RELATED APPLICATION(S)

This application claims priority to Korean Patent Application No. 10-2009-0008848, filed on Feb. 4, 2009, in the Korean Intellectual Property Office, the entire contents of which is incorporated herein by reference.

BACKGROUND

1. Field

One or more example embodiments relate to inkjet printing devices using a combination of a piezoelectric technique and an electrostatic technique, and methods of driving the same.

2. Description of the Related Art

Conventional inkjet printing devices eject fine droplets of ink onto desired positions of printing media by using inkjet heads to print given, desired or predetermined images on printing sheets. The inkjet printing devices have been applied to a larger variety of fields, for example, flat panel displays (FPDs) such as liquid crystal displays (LCDs) and organic light emitting displays (OLEDs), flexible displays such as electronic paper (e-paper), printed electronics such as metal interconnection lines, and organic thin film transistors (OTFTs). Among process techniques for applying the inkjet printing devices to display devices or printed electronics, relatively high-resolution ultrafine printing techniques may be needed.

Related art inkjet printing devices may be classified as piezoelectric inkjet printing devices and electrostatic inkjet printing devices depending on how the ink is ejected. Specifically, related art piezoelectric inkjet printing devices eject ink by deforming a piezoelectric material, while related art electrostatic inkjet printing devices eject ink using an electrostatic force. In more detail, related art electrostatic inkjet printing devices operate based on the following two methods. In a first method, ink droplets are ejected using electrostatic induction. In a second method, charged pigments are accumulated using an electrostatic force and then ink droplets are ejected.

In the case of a piezoelectric inkjet printing device, because ink is ejected by using a drop on demand (DOD) technique, it is relatively easy to control a printing operation and drive the inkjet printing device. Also, the piezoelectric inkjet printing device generates ejection energy by mechanically deforming a piezoelectric material, and thus, any kind of ink may be used. However, the piezoelectric inkjet printing device does not produce ultrafine droplets having a size of several picoliters or less nor does it allow ink droplets to reach a desired position as compared with an electrostatic inkjet printing device.

The electrostatic inkjet printing device may produce ultrafine droplets, is relatively easy to drive, and allows ink to be ejected in a desired direction. As a result, the electrostatic inkjet printing device is more appropriate for relatively precise printing processes. However, because it is difficult to form separate ink flow paths in an electrostatic inkjet printing device by using an electrostatic induction technique, ink is relatively difficult to eject via a plurality of nozzles by using the DOD technique. Also, when charged pigments accumulate due to an electrostatic force, the ejection rate of ink droplets and the kind of ink is limited because it is necessary to accumulate relatively highly dense pigments.

Moreover, in the related art the amount of ejected ink droplets is proportional to the diameters of nozzles of inkjet printing devices. Thus, it is necessary to reduce the sizes of nozzles to eject fine ink droplets. However, a reduction in the sizes of the nozzles makes it difficult to manufacture precise nozzles and causes the nozzles to clog more frequently, thereby reducing reliability.

SUMMARY

One or more example embodiments provide an inkjet printing device using a technique that is a combination of a piezoelectric technique and an electrostatic technique, and a method of driving the inkjet printing device for ejecting fine ink droplets.

At least one example embodiment provides an inkjet printing device. According to at least this example embodiment, the inkjet printing device includes a flow path plate, a plurality of pressure chambers and a plurality of nozzles. The flow path plate includes an ink inlet through which ink is supplied. The plurality of pressure chambers are filled with the supplied ink, and the ink filled in the plurality of pressure chambers is ejected through the plurality of nozzles. The inkjet printing device further includes a piezoelectric actuator and an electrostatic force applicator. The piezoelectric actuator is configured to provide a pressure change in the ink filled in the plurality of pressure chambers as a first driving force used to eject ink droplets from the plurality of nozzles. The electrostatic force applicator is configured to apply an electrostatic force to the ink filled in the plurality of nozzles as a second driving force used to eject the ink droplets from the plurality of nozzles.

At least one other example embodiment provides an inkjet printing device. According to at least this example embodiment, the inkjet printing device includes a flow path plate, at least one pressure chamber and at least one nozzle. The flow path plate includes an ink inlet through which ink is supplied. The at least one pressure chamber is filled with the supplied ink, and the ink filled in the at least one pressure chamber is ejected through the at least one nozzle. The inkjet printing device further includes a piezoelectric actuator and an electrostatic force applicator. The piezoelectric actuator is configured to provide a pressure change in the ink filled in the at least one pressure chamber as a first driving force used to eject an ink droplet from the at least one nozzle. The electrostatic force applicator is configured to apply an electrostatic force to the ink filled in the at least one nozzle as a second driving force used to eject the ink droplet from the at least one nozzle.

Yet at least one other example embodiment provides an inkjet printing device. According to at least this example embodiment, the device includes a flow path plate, a piezoelectric actuator, and an electrostatic force applicator. The flow path plate includes an ink inlet, at least one pressure chamber configured to be at least partially filled with ink supplied via the ink inlet, and at least one nozzle configured to eject the ink at least partially filling the at least one pressure chamber. The piezoelectric actuator is configured to provide a pressure change in the ink at least partially filling the at least one pressure chamber as a first driving force to eject an ink droplet from the at least one nozzle. The electrostatic force applicator is configured to apply an electrostatic force to the ink at least partially filling the at least one nozzle as a second driving force to eject the ink droplet from the at least one nozzle.

Yet at least one other example embodiment provides an inkjet printing device. According to at least this example embodiment, the device includes a flow path plate, a piezoelectric actuator, and an electrostatic force applicator. The flow path plate includes an ink inlet, at least one pressure chamber configured to be at least partially filled with ink supplied via the ink inlet, and at least one nozzle configured to eject the ink at least partially filling the at least one pressure chamber. The piezoelectric actuator is configured to generate a first driving force for ejecting an ink droplet from the at least one nozzle by reducing a volume of the at least one pressure chamber. And, the electrostatic force applicator is configured to generate a second driving force for ejecting the ink droplet from the at least one nozzle by increasing the volume of the at least one pressure chamber.

According to at least some example embodiments, the ink inlet may be formed on a top surface of the flow path plate, the at least one pressure chamber may be formed in the flow path plate, and/or the at least one nozzle may be formed on a lower surface of the flow path plate. The flow path plate may further include manifolds and a restrictor connecting the ink inlet and the at least one pressure chamber. The flow path plate may further include a damper connecting the at least one pressure chamber and the at least one nozzle. The flow path plate may be formed of a plurality of substrates.

According to at least some example embodiments, the piezoelectric actuator may include a lower electrode, a piezoelectric layer, and an upper electrode that are sequentially stacked on a top surface of the flow path plate. A first power source is connected between and configured to apply a voltage between the lower electrode and the upper electrode.

The electrostatic force applicator may include a first electrostatic electrode and a second electrostatic electrode disposed to face each other. A second power source is connected between and configured to apply a voltage between the first electrostatic electrode and the second electrostatic electrode. The first electrostatic electrode may be disposed on a top surface of the flow path plate, and the second electrostatic electrode may be spaced apart from a lower surface of the flow path plate.

According to at least some example embodiments, a guide rod may be formed in the at least one nozzle. The guide rod may extend along the center axis of the at least one nozzle. The guide rod may be supported by a bridge fixed to an inner wall surface of the at least one nozzle. The guide rod may protrude from a lower surface of the flow path plate to have a given, desired or predetermined length.

At least one other example embodiment provides a method of driving the inkjet printing device. According to at least this example embodiment, the piezoelectric actuator is deformed to reduce a volume of the at least one pressure chamber by applying a first voltage to the piezoelectric actuator. The piezoelectric actuator is deformed to increase the volume of the at least one pressure chamber by applying a second voltage to the piezoelectric actuator, and the second voltage applied to the piezoelectric actuator is removed.

According to at least some example embodiments, an electrostatic force may be applied to the ink filled in the at least one nozzle by applying an electrostatic voltage to the electrostatic force applicator. The electrostatic voltage may be maintained at least while applying the first voltage and the second voltage to the piezoelectric actuator. When applying of the first voltage to the piezoelectric actuator, a meniscus of the ink filled in the at least one nozzle may be deformed to a convex shape. When applying of the second voltage to the piezoelectric actuator, the convex meniscus having a radius of curvature smaller than an inside diameter of the at least one nozzle may be formed at the center portion of the at least one nozzle, and the ink of a protruding convex portion may be ejected in the form of a droplet due to the electrostatic force. When applying of the second voltage to the piezoelectric actuator, an ink droplet having smaller sizes than the at least one nozzle may be ejected.

When removing the applied second voltage applied to the piezoelectric actuator, the piezoelectric actuator, the pressure of the plurality of pressure chambers, and the meniscus of the ink filled in the at least one nozzle may return to their original states.

At least one other example embodiment provides a method of driving the inkjet printing device. According to at least this example embodiment, the piezoelectric actuator may be deformed to increase a volume of the at least one pressure chamber by applying a second voltage to the piezoelectric actuator. The second voltage applied to the piezoelectric actuator may be removed.

According to at least some example embodiments, an electrostatic force may be applied to the ink filled in the at least one nozzle by applying an electrostatic voltage to the electrostatic force applicator. Before applying the second voltage to the piezoelectric actuator, the piezoelectric actuator may be deformed to reduce a volume of the at least one pressure chamber by applying a first voltage to the piezoelectric actuator. In the applying of the first voltage to the piezoelectric actuator, a meniscus of the ink filled in the at least one nozzle may be deformed to a convex shape. The electrostatic voltage may be maintained at least while applying the first voltage and the second voltage to the piezoelectric actuator.

Before applying the second voltage to the piezoelectric actuator, a meniscus of a front portion of the guide rod may be deformed to the convex shape due to a surface tension caused by the guide rod. When applying of the second voltage to the piezoelectric actuator, the convex meniscus having a radius of curvature smaller than an inside diameter of the at least one nozzle may be formed in the front portion of the guide rod, and the ink of a protruding convex portion may be ejected in the form of a droplet due to the electrostatic force. When applying the second voltage to the piezoelectric actuator, an ink droplet having smaller sizes than the at least one nozzle may be ejected.

When removing of the applied second voltage applied to the piezoelectric actuator, the piezoelectric actuator, the pressure of the at least one pressure chamber, and the meniscus of the ink filled in the plurality of nozzles may return to their original states.

BRIEF DESCRIPTION OF THE DRAWINGS

The general inventive concept will become apparent and more readily appreciated from the following description of example embodiments, taken in conjunction with the accompanying drawings of which.

DETAILED DESCRIPTION

Figure 1:
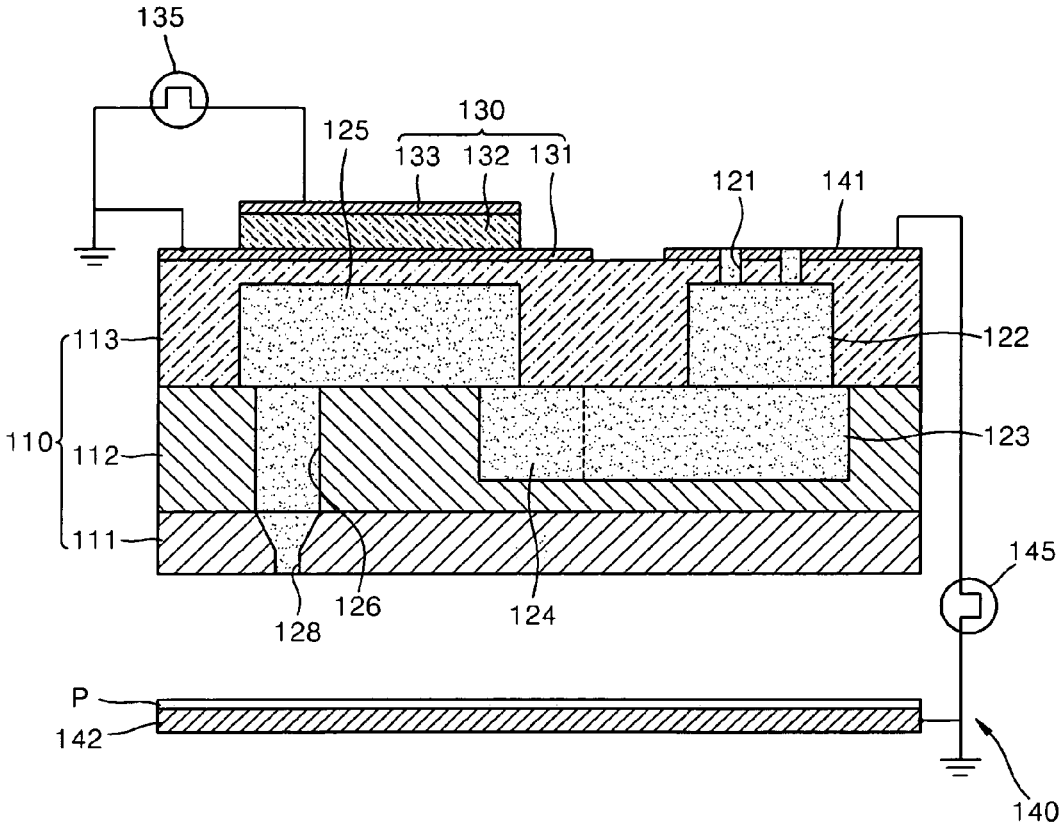
FIG. 1 is a cross-sectional view of an inkjet printing device according to an example embodiment.

Reference will now be made in detail to embodiments, examples of which are illustrated in the accompanying drawings, wherein like reference numerals refer to the like elements throughout. In this regard, the example embodiments may have different forms and should not be construed as being limited to the descriptions set forth herein. Accordingly, the example embodiments are merely described below by referring to the figures to explain aspects of the general inventive concept.

Various example embodiments will now be described more fully with reference to the accompanying drawings in which some example embodiments are shown. In the drawings, the thicknesses of layers and regions are exaggerated for clarity.

Detailed illustrative example embodiments are disclosed herein. However, specific structural and functional details disclosed herein are merely representative for purposes of describing example embodiments. This invention may, however, may be embodied in many alternate forms and should not be construed as limited to only the example embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but on the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, method steps or actions, these elements, steps or actions should not be limited by these terms. These terms are only used to distinguish one element from another. For example, a first element could be termed a second element, and, similarly, a second element could be termed a first element, without departing from the scope of example embodiments. As used herein, the term "and/or," includes any and all combinations of one or more of the associated listed items.

It will be understood that when an element or layer is referred to as being "formed on," another element or layer, it can be directly or indirectly formed on the other element or layer. That is, for example, intervening elements or layers may be present. In contrast, when an element or layer is referred to as being "directly formed on," to another element, there are no intervening elements or layers present. Other words used to describe the relationship between elements or layers should be interpreted in a like fashion (e.g., "between," versus "directly between," "adjacent," versus "directly adjacent," etc.).

The terminology used herein is for the purpose of describing particular embodiments only and is not intended to be limiting of example embodiments. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Further still, it should also be noted that in some alternative implementations, the steps/functions/acts noted may occur out of the order noted in the figures. For example, two figures shown in succession may in fact be executed substantially concurrently or may sometimes be executed in the reverse order, depending upon the steps/functionality/acts involved. In addition, the order of the steps/actions/operations/interactions may be re-arranged.

FIG. 1 is a cross-sectional view of an inkjet printing device according to an example embodiment.

Referring to FIG. 1, the inkjet printing device according to the example embodiment includes a flow path plate 110, a piezoelectric actuator 130, and an electrostatic force applicator 140. The electrostatic force applicator 140 is configured to provide a driving force for ejecting ink.

The flow path plate further includes an ink flow path. The ink flow path further includes an ink inlet 121 through which ink is supplied, at least one (e.g., a plurality of) pressure chambers 125 containing the supplied ink, and at least one (e.g., a plurality of) nozzles 128 for ejecting ink droplets. Example embodiments will be discussed herein, for the sake of clarity, as including a plurality of pressure chambers and a plurality of nozzles.

The ink inlet 121 may be formed on the top surface of the flow path plate 110 and is connected to an ink tank that is not shown. Ink is supplied from the ink tank to the flow path plate 110 via the ink inlet 121. The pressure chambers 125 are formed in the flow path plate 110, and store the ink supplied via the ink inlet 121.

Still referring to FIG. 1, the flow path plate 110 further includes manifolds 122 and 123 and a restrictor 124, which connect the ink inlet 121 and the pressure chambers 125. The nozzles 128 eject the ink filled in the pressure chambers 125 in the form of droplets and are connected to the pressure chambers 125, respectively. The nozzles 128 may be formed on the bottom surface of the flow path plate 110, and may be arranged in one or more lines (e.g., in one line or two lines). The flow path plate 110 may include a plurality of dampers 126 that connect the pressure chambers 125 and the nozzles 128.

The flow path plate 110 may be formed of a material having a highly fine workability, for example, a silicone substrate. The flow path plate 110 may have a stacked structure including a plurality of substrates stacked sequentially. In one example, the flow path plate 110 may be formed by bonding first through third substrates 111 through 113, which are sequentially stacked, using a silicone direct bonding (SDB) process. In this example, the ink inlet 121 may pass perpendicularly through a substrate disposed on the uppermost portion of the flow path plate 110 (e.g., the third substrate 113). The pressure chambers 125 may be formed on or within the bottom portion of the third substrate 113 to have a given, desired or predetermined depth. The nozzles 128 may pass perpendicularly through a substrate disposed on the lowermost portion of the flow path plate 110 (e.g., the first substrate 111). The manifolds 122 and 123 may be formed on or within the second substrate 112 disposed between the first and third substrates 111 and 113. The dampers 126 may pass perpendicularly through the second substrate 112.

Although the flow path plate 110 is described above as including three substrates 111 through 113, example embodiments are not limited thereto. Rather, the flow path plate 110 may include one substrate, two substrates, or four or more substrates. Furthermore, an ink flow path formed in the flow path plate 110 may be shaped in various ways.

The piezoelectric actuator 130 provides a pressure change as a first driving force for ejecting the ink to the pressure chambers 125. In the example embodiment shown in FIG. 1, the piezoelectric actuator 130 is disposed on the top surface of the flow path plate 110 so as to correspond to the pressure chambers 125. The piezoelectric actuator 130 includes a lower electrode 131, a piezoelectric layer 132, and an upper electrode 133, which are stacked sequentially on the top surface of the flow path plate 110. The lower electrode 131 functions as a common electrode, while the upper electrode 133 functions as a driving electrode for applying a voltage to the piezoelectric layer 132. A first power source 135 is connected between the lower electrode 131 and the upper electrode 133. The piezoelectric layer 132 is deformed by a voltage applied from the first power source 135 such that the portion of the third substrate 113 corresponding to the upper wall of the pressure chambers 125 is deformed. The piezoelectric layer 132 may be formed of a given, desired or predetermined piezoelectric material, for example, a lead zirconate titanate (PZT) ceramic or similar material.

The electrostatic force applicator 140 applies an electrostatic force as a second driving force for ejecting ink to the nozzles 128. The electrostatic force applicator 140 includes first and second electrostatic electrodes 141 and 142, which are disposed to face each other. The electrostatic force applicator 140 further includes a second power source 145 connected between and configured to apply a voltage between the first and second electrostatic electrodes 141 and 142.

Still referring to the example embodiment shown in FIG. 1, the first electrostatic electrode 141 is disposed on the flow path plate 110. As shown, the first electrostatic electrode 141 may be disposed on the top surface of the flow path plate 110 (e.g., on the top surface of the third substrate 113). The first electrostatic electrode 141 may be disposed on a region where the ink inlet 121 is formed so as to be spaced apart from the lower electrode 131 of the piezoelectric actuator 130. The second electrostatic electrode 142 may be disposed a given, desired or predetermined distance apart from the bottom surface of the flow path plate 121. Recording media P on which ink droplets ejected via the nozzles 128 of the flow path plate 110 are printed may be loaded on the second electrostatic electrode 142.

The inkjet printing device having the above-described structure uses an ink ejecting technique that is a combination of a piezoelectric technique and an electrostatic technique, thereby obtaining merits of the piezoelectric technique and the electrostatic technique. For example, the inkjet printing device according to at least this example embodiment ejects ink using a drop on demand (DOD) technique, thereby controlling a printing operation and producing ultrafine droplets more easily, as well as allowing ink to be ejected in a desired direction, thereby appropriately performing a more precise printing process.

Figure 2:
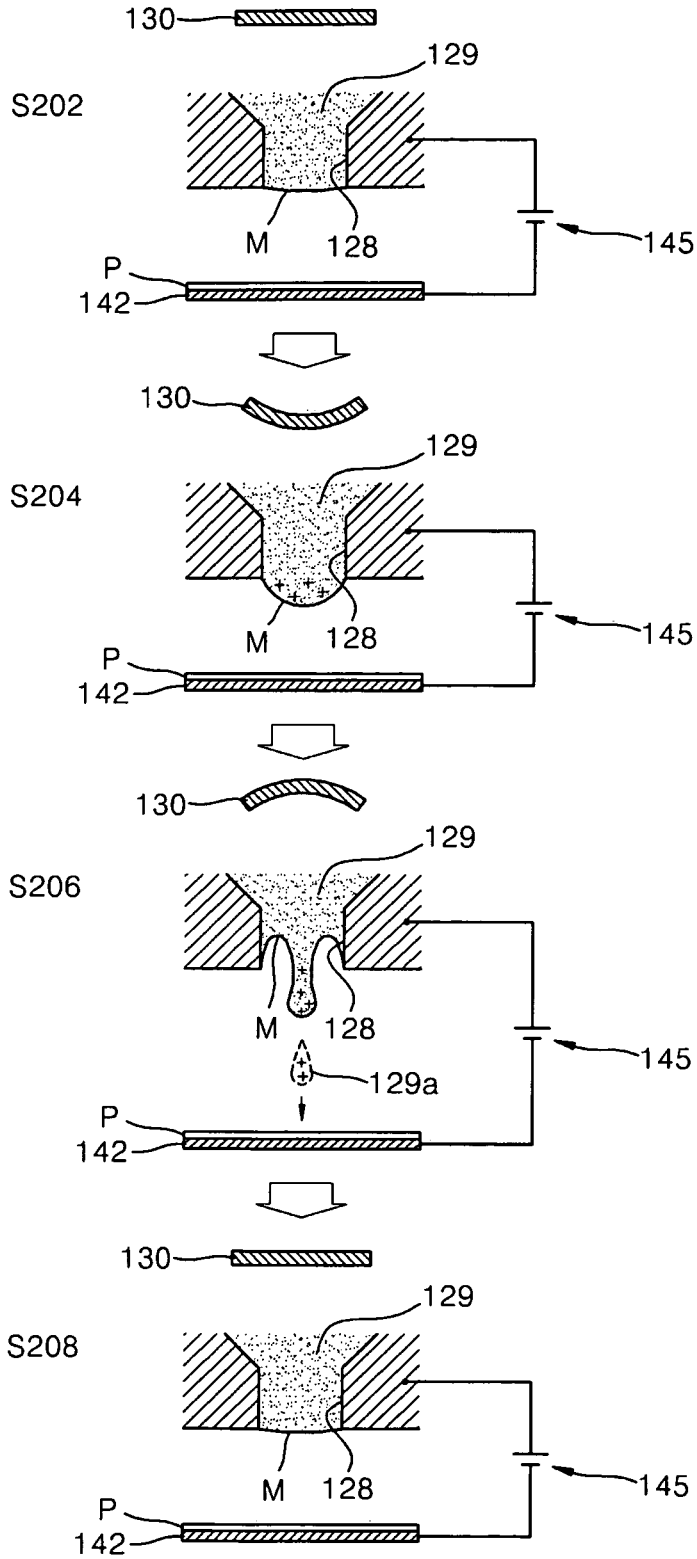
FIG. 2 is a diagram for explaining a method of driving the inkjet printing device shown in FIG. 1 according to an example embodiment.
Figure 3:
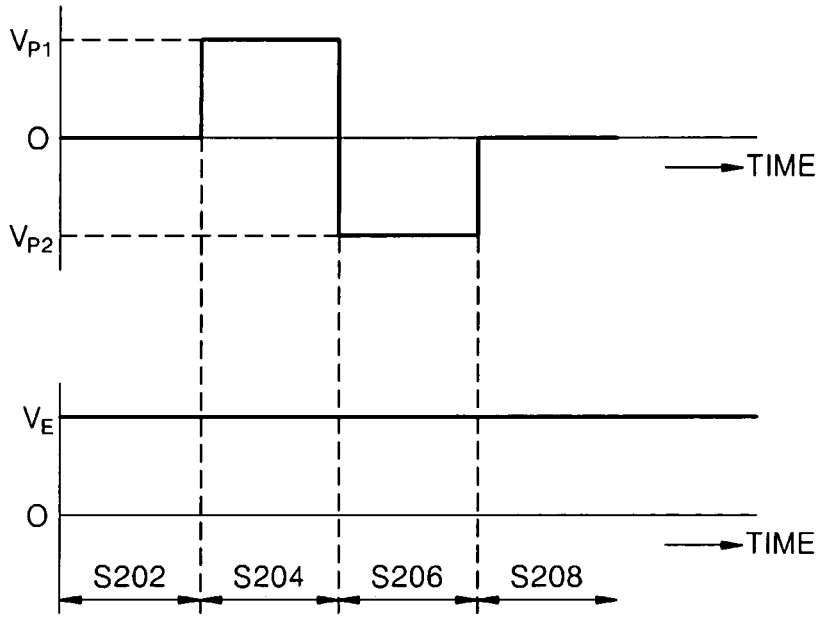
FIG. 3 shows a driving waveform applied in the method shown in FIG. 2 according to an example embodiment.

FIG. 2 is a diagram for explaining an example embodiment of a method of driving the inkjet printing device shown in FIG. 1. FIG. 3 shows a driving waveform applied in the method shown in FIG. 2 according to an example embodiment.

Referring to FIGS. 2 and 3, at S202, a voltage is not applied to the piezoelectric actuator 130, and the second power source 145 applies a given, desired or predetermined electrostatic voltage VE between the first and second electrostatic electrodes 141 and 142. In this regard, because a relatively small amount of electrostatic force is applied to ink 129 of the nozzles 128, a meniscus M of the ink 129 is in a static state.

At S204, a first voltage VP1 is applied to the piezoelectric actuator 130 to deform the piezoelectric actuator 130 thereby reducing volumes of the pressure chambers 125. The electrostatic voltage VE applied between the first and second electrostatic electrodes 141 and 142 is maintained. Thus, the pressure of the pressure chambers 125 increases so that the meniscus M of the ink 129 of the nozzles 128 is deformed to a convex shape. In this case, an electric field is collimated at the convex meniscus M so that positive charges in the ink 129 move toward the second electrostatic electrode 142 and are collected at the end portion of the nozzles 128.

At S206, a second voltage VP2 is applied to the piezoelectric actuator 130 to deform the piezoelectric actuator 130 thereby increasing volumes of the pressure chambers 125. The electrostatic voltage VE applied between the first and second electrostatic electrodes 141 and 142 is maintained. Thus, the pressure of the pressure chambers 125 is reduced so that the meniscus M of the ink 129 of the nozzles 128 sinks, whereas the center portion of the meniscus M is deformed to the convex shape due to an electrostatic force applied between accumulated charges and the second electrostatic electrode 142. As a result, the convex meniscus M having a smaller radius of curvature than an inside diameter of the nozzles 128 is formed at center portions of the nozzles 128.

In general, an electrostatic force $F_E$ is proportional to an amount of charges q and an intensity E of the electric field as shown in equation 1 below. The amount of charges q is proportional to the intensity E of the electric field as shown in equation 2 below. The electrostatic force $F_E$ is proportional to a square of the intensity E of the electric field as shown in equation 3 below. As shown below in equation 4, the intensity E of the electric field is proportional to the electrostatic voltage $V_E$, but inversely proportional to the radius of curvature $r_m$ of the meniscus M. Thus, the electrostatic force $F_E$ applied to the ink 129 of a portion that protrudes relatively sharply from the end portion of the nozzles 128 is inversely proportional to a square of the radius of curvature $r_m$ of the meniscus M as shown in equation 5.

$$F_E \propto qE \tag{1}$$

$$q \propto E \tag{2}$$

$$F_E \propto E^2 \tag{3}$$

$$E \propto \frac{V_E}{r_m} \tag{4}$$

$$F_E \propto \left(\frac{V_E}{r_m}\right)^2 \tag{5}$$

As shown above, the electrostatic force $F_E$ applied to the ink 129 of the relatively sharply protruding portion increases so that the radius of curvature $r_m$ of the meniscus M at the center portion of the nozzles 128 is further reduced, which further increases the electrostatic force $F_E$. The ink 129 of the relatively sharply protruding portion is ejected in the form of droplets 129*a* from the nozzles 128. In this regard, because the ink 129 sharply protrudes from the center portion of the nozzles 128, relatively small (e.g., very small) sizes of ink droplets 129' are ejected as compared to sizes of the nozzles 128. The ink droplets 129*a* move to the second electrostatic electrode 142 due to the electrostatic force $F_E$ and are printed on the recording media P.

Referring back to FIG. 2, at S208, if the second voltage $V_{P2}$ applied to the piezoelectric actuator 130 is removed, the piezoelectric actuator 130 returns to an original state and the pressure of the pressure chambers 125 returns to an original state, so that the sunken meniscus M also returns to an original state. In this regard, the electrostatic voltage $V_E$ applied between the first and second electrostatic electrodes 141 and 142 is maintained.

Although the electrostatic voltage $V_E$ applied between the first and second electrostatic electrodes 141 and 142 is maintained during the actions S202 through S208, the electrostatic voltage $V_E$ may be maintained only during some of actions S202 through S208 as described below.

Figure 4:
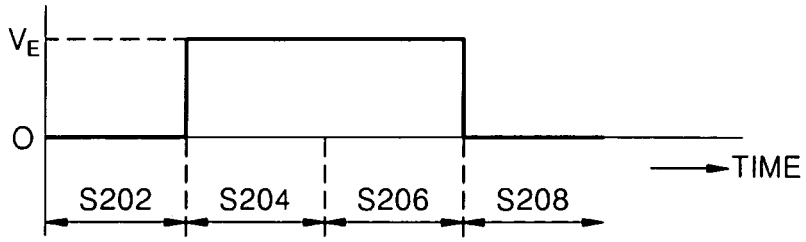
FIG. 4 shows a driving waveform applied in the method shown in FIG. 2 according to another example embodiment.

FIG. 4 shows a driving waveform applied in the method shown in FIG. 2 according to another example embodiment.

Referring to FIG. 4, in this example embodiment the electrostatic voltage $V_E$ applied between the first and second electrostatic electrodes 141 and 142 is maintained during actions S204 and S206, but not during actions S202 and S208 in which the meniscus M is maintained in a static state.

As described above, the method of driving the inkjet printing device according to at least this example embodiment ejects the ink droplets 129*a* that are smaller (e.g., much smaller) than the nozzles 128. In more detail, ultrafine droplets having a size of several picoliters or less are ejected via the nozzles 128 having relatively large diameters (e.g., several μm through several tens of μm), without the need to reduce the sizes of the nozzles 128. The nozzles 128 have relatively large diameters while ejecting ultrafine droplets, which reduces a possibility of the nozzles 128 getting clogged, thereby increasing reliability. Furthermore, the electric field is focused on a part of the ink meniscus M, thereby maintaining a relatively low electrostatic voltage when generating a given, desired or predetermined amount of electrostatic force.

Figure 5:
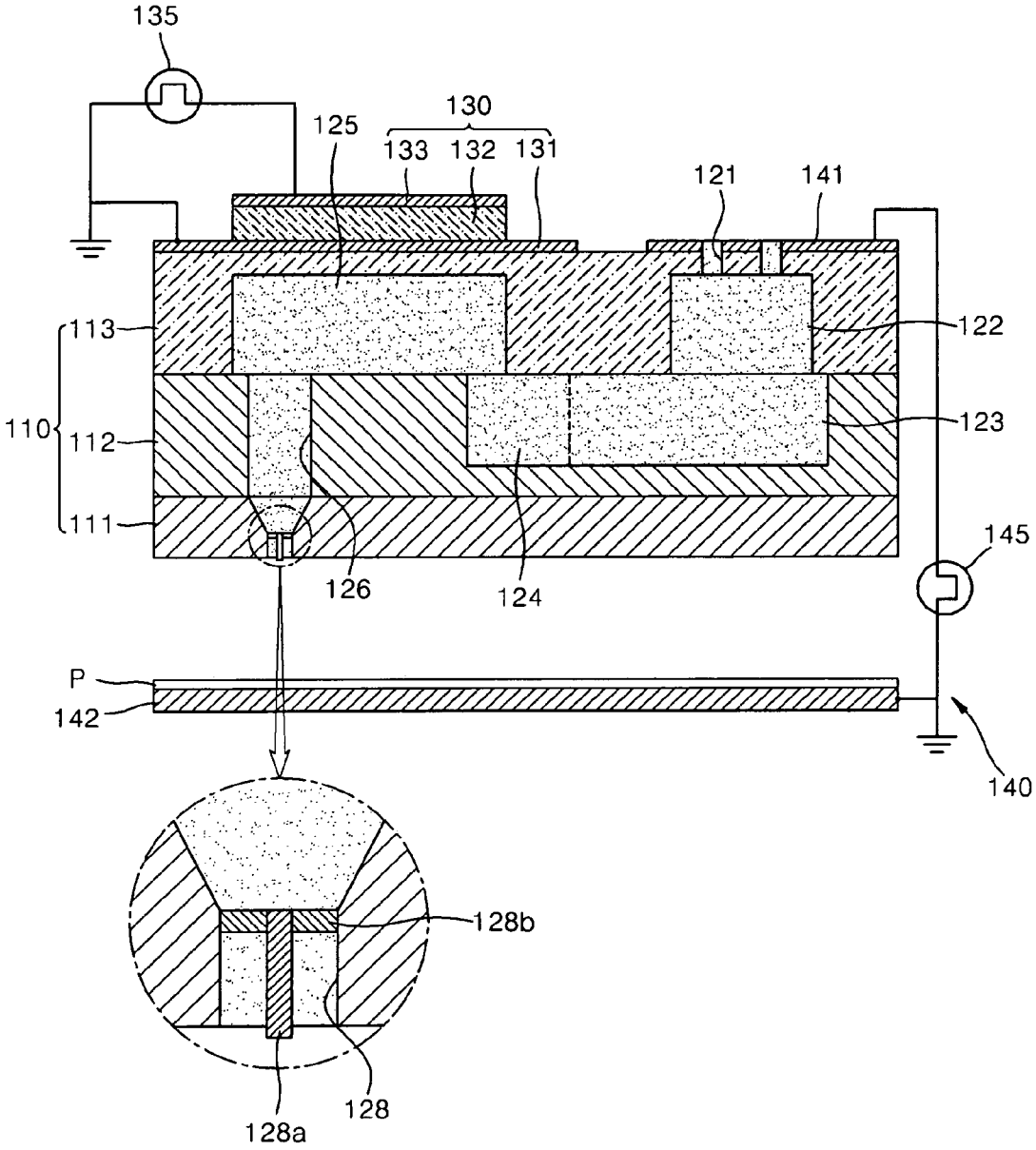
FIG. 5 is a cross-sectional view of an inkjet printing device according to another example embodiment.
Figure 6:
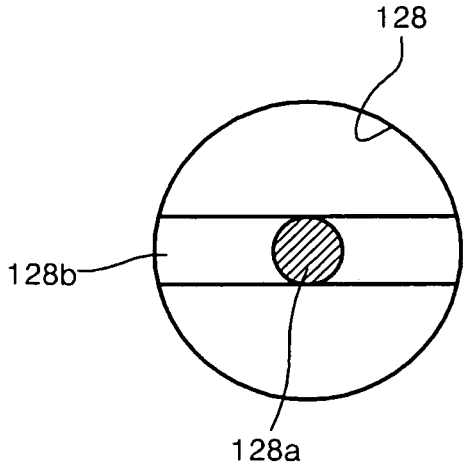
FIG. 6 is a plan view of nozzles, a guide rod, and a bridge shown in FIG. 5.

FIG. 5 is a cross-sectional view of an inkjet printing device according to another example embodiment. FIG. 6 is a plan view of the nozzles 128, a guide rod 128*a*, and a bridge 128*b* shown in FIG. 5. Because the inkjet printing device shown in FIGS. 5 and 6 is the same as the inkjet printing device shown in FIG. 1 except for the construction of the nozzles 128, only the nozzles 128 will be described below with reference to FIGS. 5 and 6.

Referring to FIGS. 5 and 6, the guide rod 128a may be disposed in the nozzles 128 along a center axis of the nozzles 128. In this example embodiment, the guide rod 128*a* protrudes from the lower surface of the flow path plate 110 to have a given, desired or predetermined length. The guide rod 128*a* is supported by the bridge 128*b*. The bridge 128b is fixed to an inner wall surface of the nozzles 128.

Figure 7:
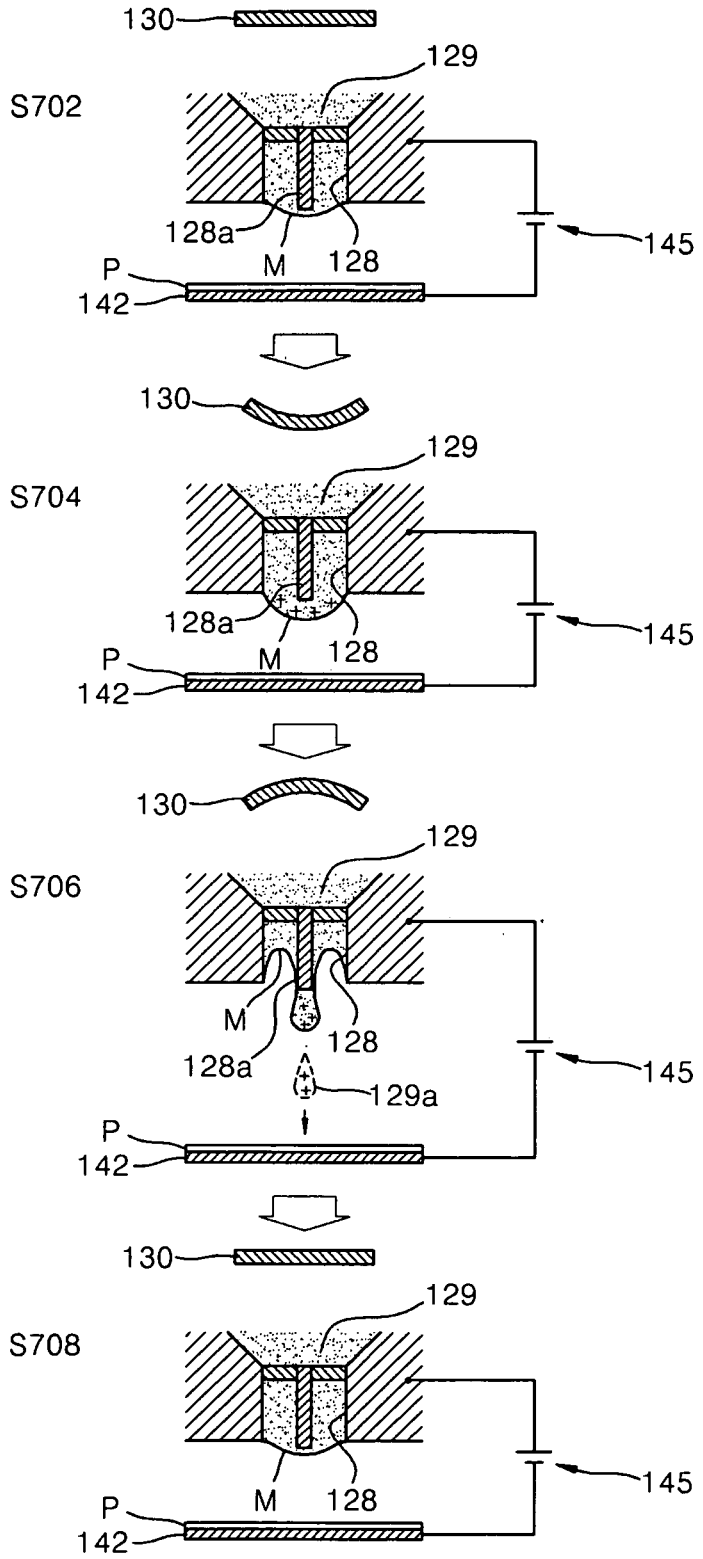
FIG. 7 is a diagram for explaining a method of driving the inkjet printing device shown in FIG. 5 according to an example embodiment.

FIG. 7 is a diagram for explaining an example embodiment of a method of driving the inkjet printing device shown in FIG. 5. The driving waveform shown in FIG. 3 is applied to the method of driving the inkjet printing device shown in FIG. 7.

Referring to FIGS. 3 and 7, at S702, no voltage is applied to the piezoelectric actuator 130, and the second power source 145 applies the given, desired or predetermined electrostatic voltage $V_E$ between the first and second electrostatic electrodes 141 and 142. Because a relatively small amount of electrostatic force is applied to the ink 129 of the nozzles 128, the meniscus M of the ink 129 is in a static state. However, the meniscus M of a front portion of the guide rod 128*a* slightly protrudes due to a surface tension caused by the guide rod 128*a* disposed at the center portion of the nozzles 128.

At S704, the first voltage $V_{P1}$ is applied to the piezoelectric actuator 130 to deform the piezoelectric actuator 130 thereby reducing volumes of the pressure chambers 125. In this regard, the electrostatic voltage $V_E$ applied between the first and second electrostatic electrodes 141 and 142 is maintained. Thus, the pressure of the pressure chambers 125 increases such that the meniscus M of the ink 129 of the nozzles 128 is deformed to a convex shape. An electric field is collimated at the convex meniscus M so that positive charges in the ink 129 move toward the second electrostatic electrode 142 and collect at the end portion of the nozzles 128.

At S706, the second voltage $V_{P2}$ is applied to the piezoelectric actuator 130 to deform the piezoelectric actuator 130 thereby increasing volumes of the pressure chambers 125. The electrostatic voltage $V_E$ applied between the first and second electrostatic electrodes 141 and 142 is maintained. Thus, the pressure of the pressure chambers 125 is reduced such that the meniscus M of the ink 129 of the nozzles 128 sinks, whereas the center portion of the meniscus M maintains the convex shape due to an electrostatic force applied between accumulated charges and the second electrostatic electrode 142. In this regard, the convex meniscus M is more easily formed in the front of the guide rod 128*a* due to a surface tension caused by the guide rod 128*a*. Thus, the convex meniscus M having a smaller radius of curvature than an inside diameter of the nozzles 128 is formed at center portions of the nozzles 128.

As described above, the electrostatic force $F_E$ applied to the ink 129 of the relatively sharply protruding portion increases, so that the radius of curvature $r_m$ of the meniscus M of the center portion of the nozzles 128 is further reduced, which further increases the electrostatic force $F_E$. The ink 129 of the relatively sharply protruding portion is ejected in the form of droplets 129*a* from the nozzles 128. In this regard, because the ink 129 sharply protrudes from the center portion of the nozzles 128, relatively small (e.g., very small) size ink droplets 129' are ejected as compared to the sizes of the nozzles 128. The ink droplets 129*a* move toward the second electrostatic electrode 142 due to the electrostatic force $F_E$ and are printed on the recording media P.

Still referring to FIG. 7, at S708, if the second voltage $V_{P2}$ applied to the piezoelectric actuator 130 is removed, the piezoelectric actuator 130 returns to an original state and the pressure of the pressure chambers 125 returns to an original state, so that the sunken meniscus M also returns to an original state. In this regard, the electrostatic voltage $V_E$ applied between the first and second electrostatic electrodes 141 and 142 is maintained.

Although the example embodiment shown in FIG. 7 is described above with regard to the electrostatic voltage $V_E$ applied between the first and second electrostatic electrodes 141 and 142 being maintained during actions S702 through S708, the electrostatic voltage $V_E$ may be maintained only during actions S704 and S706 as shown in FIG. 4.

The method of driving the inkjet printing device shown in FIG. 7 more easily forms the meniscus M having a pronounced bulge at the center portion of the nozzles 128 by applying the surface tension caused by the guide rod 128*a* disposed at the center portions of the nozzles 128 and the electrostatic force as well.

Figure 8:
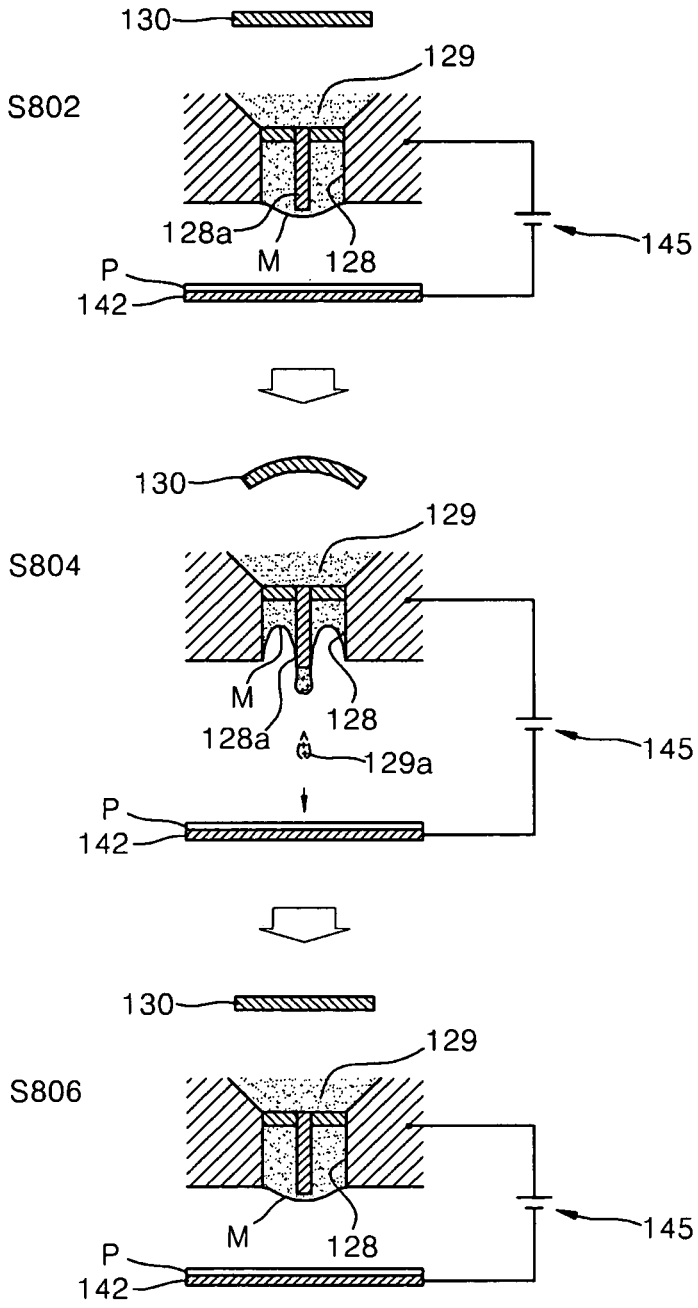
FIG. 8 is a diagram for explaining a method of driving the inkjet printing device shown in FIG. 5 according to another example embodiment.
Figure 9:
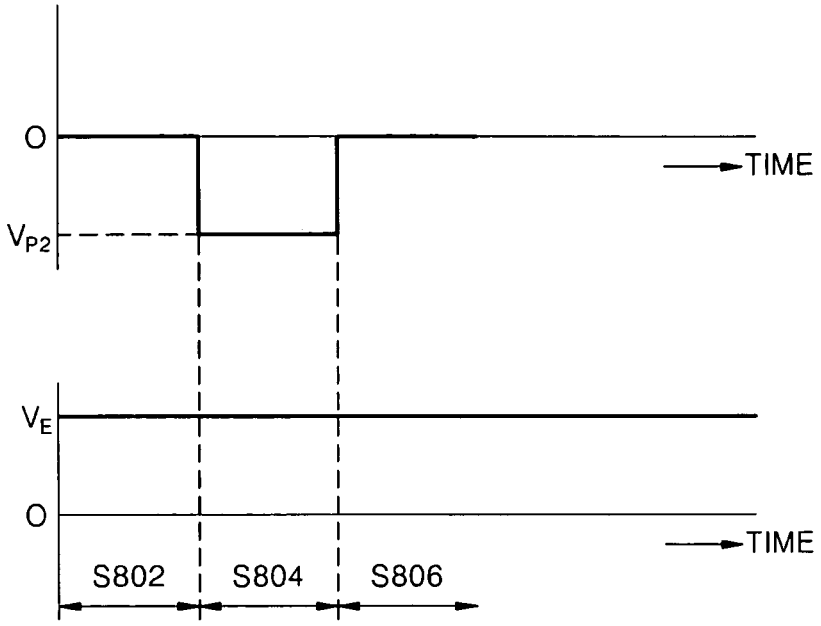
FIG. 9 shows a driving waveform applied in the method shown in FIG. 8 according to an example embodiment.

FIG. 8 is a diagram for explaining a method of driving the inkjet printing device shown in FIG. 5 according to another example embodiment. FIG. 9 shows a driving waveform applied in the method shown in FIG. 8 according to an example embodiment.

Referring to FIGS. 8 and 9, at S802, no voltage is applied to the piezoelectric actuator 130, and the second power source 145 applies the given, desired or predetermined electrostatic voltage $V_E$ between the first and second electrostatic electrodes 141 and 142. Because a relatively small amount of electrostatic force is applied to the ink 129 of the nozzles 128, the meniscus M of the ink 129 is in a static state. However, the meniscus M of a front portion of the guide rod 128*a* slightly protrudes due to a surface tension caused by the guide rod 128*a* disposed at the center portion of the nozzles 128. Positive charges accumulate in the slightly bulging portion of the front portion of the guide rod 128*a* due to the electrostatic force.

At S804, the second voltage $V_{P2}$ is applied to the piezoelectric actuator 130 to deform the piezoelectric actuator 130 thereby increasing volumes of the pressure chambers 125. In this regard, the electrostatic voltage $V_E$ applied between the first and second electrostatic electrodes 141 and 142 is maintained. Thus, the pressure of the pressure chambers 125 is reduced so that the meniscus M of the ink 129 of the nozzles 128 sinks, whereas the center portion of the meniscus M (e.g., the front portion of the guide rod 128*a*) maintains the convex shape due to an electrostatic force applied between accumulated charges and the second electrostatic electrode 142 and due to a surface tension caused by the guide rod 128*a*.

Because the method shown in FIG. 8 does not perform, for example, action S704 shown in FIG. 7, a relatively small (e.g., very small) amount of the ink 129 remains in the front portion of the guide rod 128a, and thus, the meniscus M has a relatively small (e.g., very small) radius of curvature. Therefore, the electrostatic force $F_E$ applied to the ink 129 remaining in the front portion of the guide rod 128*a* increases, so that the ink 129 is ejected in the form of the droplets 129*a*. The ink droplets 129*a* move toward the second electrostatic electrode 142 due to the electrostatic force $F_E$ and are printed on the recording media P.

Referring still to FIG. 8, at S806, if the second voltage $V_{P2}$ applied to the piezoelectric actuator 130 is removed, the piezoelectric actuator 130 returns to an original state and the pressure of the pressure chambers 125 returns to an original state, so that the sunken meniscus M also returns to an original state. In this regard, the electrostatic voltage $V_E$ applied between the first and second electrostatic electrodes 141 and 142 is maintained.

As described above, the method of driving the inkjet printing device shown in FIGS. 8 and 9 ejects the ink droplets 129*a* having ultrafine (e.g., very ultrafine) sizes compared to those described with reference to FIG. 7 because the relatively small (e.g., very small) amount of the ink 129 remains in the front portion of the guide rod 128*a* disposed at the center portions of the nozzles 128.

Figure 10:
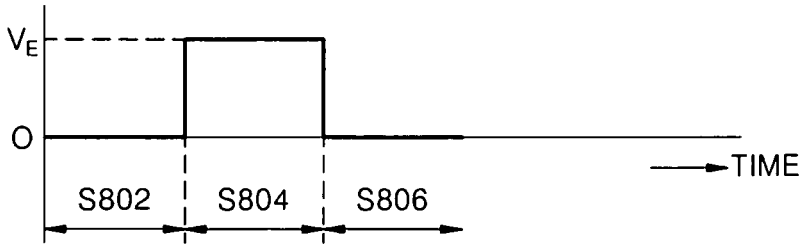
FIG. 10 shows a driving waveform applied in the method shown in FIG. 8 according to another example embodiment.

FIG. 10 shows a driving waveform applied in the method shown in FIG. 8 according to another example embodiment.

Referring to FIG. 10, the electrostatic voltage $V_E$ applied between the first and second electrostatic electrodes 141 and 142 is maintained during action S804, but not during actions S802 and S806 in which no voltage is applied to the piezoelectric actuator 130 and the meniscus M is maintained in a static state.

It should be understood that the example embodiments described herein should be considered in a descriptive sense only and not for purposes of limitation. Descriptions of features or aspects within each example embodiment should typically be considered as available for other similar features or aspects in other embodiments.

What is claimed is:

1. An inkjet printing device comprising:

a flow path plate including, an ink inlet, at least one pressure chamber configured to be at least partially filled with ink supplied via the ink inlet, and at least one nozzle configured to eject the ink at least partially filling the at least one pressure chamber;

a piezoelectric actuator configured to generate a first driving force for ejecting an ink droplet from the at least one nozzle by changing a pressure in the at least one pressure chamber; and an electrostatic force applicator configured to apply an electrostatic force to the ink as a second driving force to eject the ink droplet from the at least one nozzle, wherein a guide rod is formed in the at least one nozzle and extends along the center axis of the at least one nozzle, and the guide rod protrudes from an ejection surface of the flow path plate, and the ink droplet ejects from the ejection surface of the flow path plate, the ejection surface being a lowermost surface of the inkjet printing device from which the ink droplet is ejected.

2. The device of claim 1, wherein the ink inlet is formed on a top surface of the flow path plate, the at least one pressure chamber is formed within the flow path plate, and the at least one nozzle is formed on a lower surface of the flow path plate.

3. The device of claim 1, wherein the flow path plate further comprises:

a plurality of manifolds and a restrictor connecting the ink inlet and the at least one pressure chambers; and a damper connecting the at least one pressure chamber and the at least one nozzle.

4. The device of claim 1, wherein the flow path plate is formed of a plurality of substrates.

5. The device of claim 1, wherein the piezoelectric actuator comprises:

a lower electrode, a piezoelectric layer, and an upper electrode that are sequentially stacked on a top surface of the flow path plate; and a first power source connected between the lower electrode and the upper electrode.

6. The device of claim 1, wherein the electrostatic force applicator comprises:

a first electrostatic electrode and a second electrostatic electrode that are disposed to face each other; and a second power source connected between the first electrostatic electrode and the second electrostatic electrode.

7. The device of claim 6, wherein the first electrostatic electrode is disposed on a top surface of the flow path plate, and the second electrostatic electrode is spaced apart from a lower surface of the flow path plate.

8. The device of claim 1, wherein the guide rod is supported by a bridge fixed to an inner wall surface of the at least one nozzle.

9. A method of driving the inkjet printing device of claim 1, the method comprising:

deforming the piezoelectric actuator to increase a volume of the at least one pressure chamber by applying a second voltage to the piezoelectric actuator; and removing the second voltage applied to the piezoelectric actuator.

10. The method of claim 9, further comprising:

applying an electrostatic force to ink in the at least one nozzle by applying an electrostatic voltage to the electrostatic force applicator.

11. The method of claim 10, further comprising:

deforming the piezoelectric actuator to reduce a volume of the at least one pressure chamber by applying a first voltage to the piezoelectric actuator before applying the second voltage to the piezoelectric actuator.

12. The method of claim 11, wherein a meniscus of the ink in the at least one nozzle is deformed to a convex shape when the first voltage is applied to the piezoelectric actuator.

13. The method of claim 11, wherein the electrostatic voltage is maintained at least while applying the first voltage and the second voltage to the piezoelectric actuator.

14. The method of claim 10, wherein a meniscus of a front portion of the guide rod is deformed to a convex shape due to a surface tension caused by the guide rod before the second voltage is applied to the piezoelectric actuator.

15. The method of claim 10, wherein the convex meniscus having a radius of curvature smaller than an inside diameter of the at least one nozzle is formed at a front portion of the guide rod and ink of a protruding convex portion is ejected in the form of a droplet due to the electrostatic force when the second voltage is applied to the piezoelectric actuator.

16. The method of claim 15, wherein the at least one nozzle ejects an ink droplet having a size smaller than the at least one nozzle when the second voltage is applied to the piezoelectric actuator.

17. The method of claim 10, wherein the piezoelectric actuator, the pressure of the at least one pressure chamber, and the meniscus of the ink in the at least one nozzle returns to their original states when the second voltage applied to the piezoelectric actuator is removed.

18. The device of claim 1, wherein the first driving force includes a first voltage and a second voltage, the second voltage having a polarity opposite to the first voltage, and the second driving force remains constant during the application of the first driving force.

* * * * *